US006329030B1

(12) United States Patent
Lafond

(10) Patent No.: US 6,329,030 B1
(45) Date of Patent: Dec. 11, 2001

(54) COMPOSITE INSULATED GLASS ASSEMBLY AND METHOD OF FORMING SAME

(76) Inventor: Luc Lafond, LL Lafond Intellectual Properties Inc. 23 Woodvalley Dr., Etobicoke ON (CA), M9A 4J4

( * ) Notice: Subject to any disclaimer, the term of this patent is extended or adjusted under 35 U.S.C. 154(b) by 0 days.

(21) Appl. No.: 09/070,385

(22) Filed: May 1, 1998

Related U.S. Application Data

(60) Provisional application No. 60/045,328, filed on May 2, 1997.

(51) Int. Cl.[7] ..... E06B 3/24

(52) U.S. Cl. ..... 428/34; 428/81; 428/192; 156/107; 156/109; 52/786.13

(58) Field of Search ..... 428/34, 192, 156, 428/167, 81, 122; 52/786.1, 786.13; 156/1.7, 109

(56) References Cited

U.S. PATENT DOCUMENTS

| | | | | |
|---|---|---|---|---|
| 3,974,011 | | 8/1976 | Jarchow et al. | 156/107 |
| 3,994,109 | * | 11/1976 | Pandell | 428/34 |
| 4,080,482 | * | 3/1978 | Lacombe | 428/34 |
| 4,145,237 | | 3/1979 | Mercier et al. | 156/109 |
| 4,234,372 | | 11/1980 | Bernhard et al. | 156/356 |
| 4,295,914 | | 10/1981 | Checko | 156/357 |
| 4,546,723 | | 10/1985 | Leopold et al. | 118/669 |
| 4,551,364 | | 11/1985 | Davies | 156/357 |
| 4,561,929 | | 12/1985 | Lenhardt | 156/522 |
| 4,743,336 | | 5/1988 | White | 156/522 |
| 4,756,789 | | 7/1988 | Kolff | 156/391 |
| 4,769,105 | | 9/1988 | Lisec | 156/468 |
| 4,826,547 | | 5/1989 | Lenhardt | 156/109 |
| 4,902,213 | | 2/1990 | Lisec | 425/113 |
| 4,961,975 | * | 10/1990 | Bejnar | 428/34 |
| 5,286,537 | * | 2/1994 | Oita et al. | 428/34 |
| 5,472,558 | | 12/1995 | Lafond | 156/523 |
| 5,635,019 | | 6/1997 | Lafond | 156/574 |

FOREIGN PATENT DOCUMENTS

| | | |
|---|---|---|
| 88 11 262 | 10/1998 | (DE) . |
| 0 152 807 | 8/1985 | (EP) . |
| 0 258 801 | 3/1988 | (EP) . |
| 2 421 852A | 11/1979 | (FR) . |
| 2 104 139A | 3/1983 | (GB) . |
| WO98/22687 | 5/1998 | (WO) . |

* cited by examiner

*Primary Examiner*—Donald Loney
(74) *Attorney, Agent, or Firm*—McFadden, Fincham

(57) ABSTRACT

The invention relates to a composite insulated glass assembly, comprising a pair of spaced substrates with a flexible and resilient polymeric spacing member between the substrates, at the periphery thereof. At joints in the spacer, or at corners, where small incisions may be made for ease in forming corners, and such similar discontinuities, sealing material is positioned, bonded in the space to fill any gap or opening and restore any reduction in thermal or other value of the spacer at these positions. The spacer is conveniently positioned adjacent the periphery of the assembly and is substantially free of sealing material except at the corners.

23 Claims, 2 Drawing Sheets

COMPOSITE INSULATED GLASS ASSEMBLY AND METHOD OF FORMING SAME

This application claims benefit of Provisional Appl. 60/045,328, filed May 2, 1997.

FIELD OF THE INVENTION

This invention relates to composite insulated glass assemblies, and more particularly to a method of improving the integrity and effectiveness of the seal between spaced apart substrates in a glass assembly, and to assemblies having the improved seal. The invention relates in particular to seals formed wholly of flexible polymers having insulative qualities, and to glass assemblies featuring a relatively simple fabrication process.

BACKGROUND OF THE INVENTION

The manufacture of composite insulated glass assemblies by applying a spacer between spaced glass substrates at the periphery of the substrates is well known. The majority of commercially available spacers comprise a rigid metal structure, which may also incorporate an insulating polymeric layer. Increasingly, spacers fabricated entirely of resilient flexible polymeric material are used for their improved insulating and sealing abilities. However, after application of the spacer, there may be a peripherally extending gap. A major problem can occur at corners and/or at the joints between the adjacent ends of the spacer, and in fact at any position where the cross section of the spacer is reduced. This problem has been addressed in the past by costly and labor-intensive solutions. For example, metal composite spacers typically feature a butt joint at each corner at the intersection between adjacent spacers. The abutting spacers are joined by means of an insert or a mating structure. This arrangement is subject to eventual leakage as the window shifts, and is labor-intensive to assemble. In a resilient flexible spacer, to provide for a relatively sharp corner at the window corners, the spacer can form separate lengths that join at one or more corners. Alternatively, the spacer may be cut partway through to permit the spacer to describe a sharp bend.

As is well known, any discontinuity in the spacer creates significant energy losses and results in a weak spot through which moisture can leak. Previously, it has been proposed that taping be used or alternatively simply applying a filler material which is not bonded to the spacer.

A further limitation of the prior art resides in the position of the spacer relative to the periphery of the glass substrates. Conventional polymeric spacers comprise a generally unitary body and it is difficult to maintain a gas impermeable seal between the spacer and the glass substrates. Conventionally, the seal is improved by maintaining a space between the periphery of the spacer and the periphery of the glass substrates, and applying a substantially impermeable backspace material within this gap, about the entire periphery of the assembly. Accordingly, it is desirable to provide a method for fabricating an assembly with a flexible polymeric, insulating spacer that eliminates the need to backfill the entire periphery of the glass assembly. This may be accomplished if the spacer includes an at least partial discontinuity at the corners, thus permitting a relatively sharp bend of the spacer and positioning of the spacer substantially adjacent to the periphery of the glass substrates. The discontinuity may be introduced if specific steps are taken to ensure that the thermal integrity of the spacer is not compromised at the discontinuity. As well, an improved spacer may be used in an assembly, wherein the spacer incorporates a substantially gas-impermeable vapour barrier membrane and is characterized by an improved seal. The use of such a spacer, permits the spacer to be positioned substantially adjacent to the periphery of the glass thus substantially eliminating the need to backfill about the entire periphery of the assembly.

SUMMARY OF THE INVENTION

It is a prime objective of the present invention to provide a method of positioning a sealant material capable of chemically fusing with the spacer material, at positions where the cross section of the spacer is reduced, or there exists a gap between spacer segments, and to provide assemblies embodying sealant material chemically fused to the spacer material.

A further object is to provide a method of assembling an insulating glass assembly featuring a polymeric insulating spacer whereby backfill between the periphery of the spacer and the periphery of the substrates is required only partway around the periphery of the structure.

In one aspect, the present invention comprises a method of forming an insulated glass assembly including a pair of substrates with corners, comprising the steps of:

- positioning a continuous length of flexible insulating polymeric spacer between the substrates about the periphery of the substrates, said spacer defined by an exterior face and an interior face;
- wherein the spacer is characterized by at least one at least partial discontinuity adjacent at least one corner;
- providing a sealant material having a melting point lower than a melting point of the spacer, the sealant comprising a material chemically compatible with the spacer and capable of fusing therewith; and
- introducing melted sealant material into contact with the spacer at corner substantially filling the discontinuity to form a generally integral one piece fused gas impervious junction between the spacer and the sealant material to restore the coefficient of thermal conductivity of the corner portions to substantially equal or exceed the coefficient of thermal conductivity of the continuous length of the spacer material. The spacer may be incised to create a Vee-shaped opening facing the exterior of the assembly at the corner of the assembly.

Conveniently, the spacer comprises a multicomponent structure featuring a first layer comprising a resilient insulating material and a second layer comprising a flexible substantially gas impervious layer. The spacer is positioned on the substrates such that the first layer faces the perimeter of the assembly and the second layer faces the interior of the assembly, with the discontinuity extending substantially through the first layer but not into the second layer.

Further, the spacer may remain substantially free from contact with the sealant except at one or more corners, where the sealant is applied to fill in discontinuities within the spacer.

In another aspect, the invention comprises a composite insulated glass assembly having corners and corner angles and comprising:

- a pair of glass substrates in spaced relation, each defined by corners and an outer edge at the perimeter thereof;
- an insulating spacer body between and spacing the substrates, the spacer body featuring an at least partial discontinuity therein generally adjacent at least one of said corners; and sealant material within said discontinuity in contact with and bonded to the spacer body. The spacer body is substantially free from contact with the sealant material except at the corners of the assembly.

It will be noted that the term "glass" as used herein includes substitutes such as Plexiglass™.

The invention will be fully understood by the description of certain embodiments, in conjunction with the accompanying drawings.

BRIEF DESCRIPTION OF THE DRAWINGS

FIG. 1(*a*) is a perspective view as in FIG. 1, showing the invention in use with an alternative spacer;

DETAILED DESCRIPTION

Figure 1:
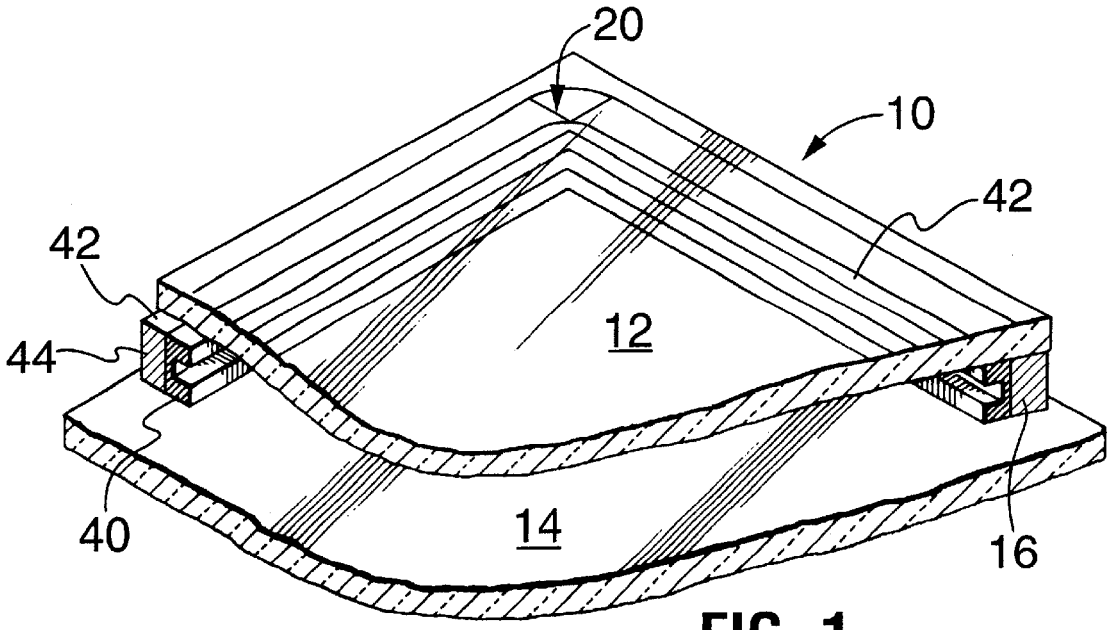
FIG. 1 is a perspective view of a portion of an insulated glass assembly.
Figure 1A:
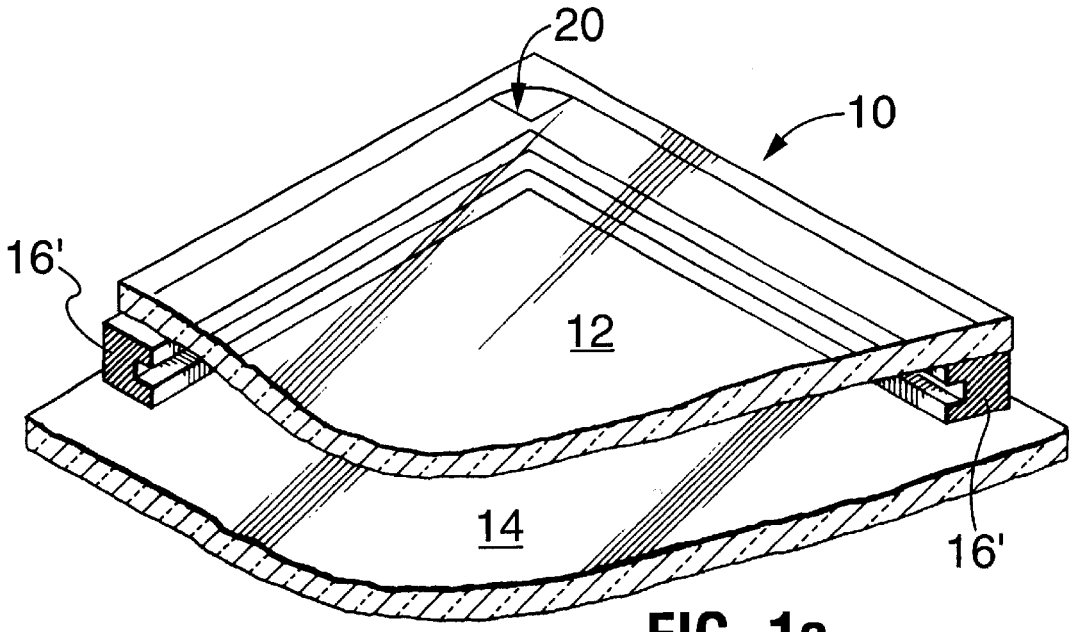

Referring now to FIG. 1, shown is an insulated glass assembly, broadly denoted by numeral 10. The assembly 10 includes a pair of spaced apart glass substrates 12 and 14 with a typical insulating polymeric spacer spacing substrates 12 and 14, positioned about the periphery of the assembly 10 at a position substantially adjacent the periphery of the glass substrates. The spacer in this version comprises a composite, consisting of an inner layer 40 formed from a resilient flexible cellular material, a vapour barrier which may comprise a substantially gas-impervious layer such as a membrane 42 and an outer layer 44 formed from a resilient cellular material. The cellular compound or compounds that comprise the components are flexible and preferably resilient. One or more of the components may comprise a foamed polymeric compound. Where the spacer is bent about a corner, a slit is cut into the spacer, extending from the outer layer 44 inwardly towards the membrane 42. The membrane 42 remains intact. The slit thus forms a pie-shaped opening when extended around the corner, with the apex pointing inwardly towards the interior of the assembly 10 and the wide side opening to the periphery of the assembly.

FIG. 1(*a*) illustrates an alternative version wherein the spacer body comprises a unitary member 16' formed from a resilient flexible cellular material.

Figure 2:
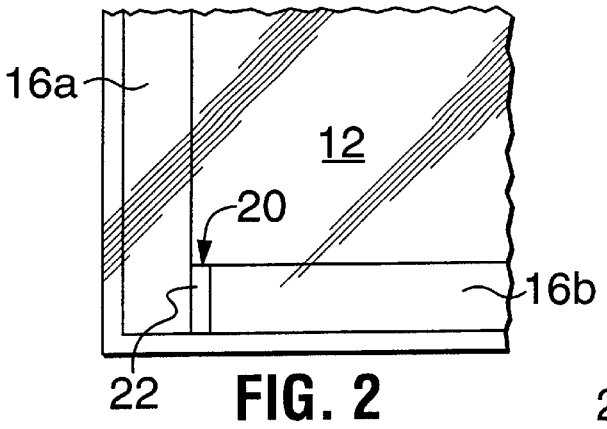
FIG. 2 is an enlarged view of two adjacent spacer sections at a corner of the assembly.

FIG. 2 illustrates, in a sectional view parallel to the plane of the substrates, two adjacent portions of spacer 16 where each section 16 meets at a juncture or gap 20 where the spacer is discontinuous at the point of intersection of two adjacent sections 16(*a*) and (*b*) meeting at a corner of the spacer assembly. The intersecting sections are mitred, in effect producing a butt joint, and the adjacent sections 16 substantially intersect at the terminal corner of the insulated assembly. As is well known in this art, any point where there is a discontinuity in the length of spacer 16 results in significant energy losses and effectively creates a weak spot in the assembly through which moisture and thermal energy can leak to be transmitted. This has ramifications in terms of lowering the useable lifespan of the assembly and contributes to the "fogging" or white clouding on the glass substrates.

In order to alleviate this, it has been found that if the adjacent sections 16 at the gap 20 can be fused or chemically bonded together, the results are quite dramatic in terms of restoring the thermal integrity of length of spacer 16 effectively to that of a continuous length. This is achieved since the chemical bond effectively fuses the two adjacent sections together at the junction 20 to restore the integrity of the seal to the point that the thermal properties are effectively the same as that which would be encountered if the seal were integral and one piece about the entire periphery of the assembly 10. In FIG. 2, a sealant 22 is positioned between the adjacent ends of the spacer 16.

Preferably, the spacer 16 will include at least one polymer capable of bonding with a suitable polymeric sealant. As one example, the spacer may be composed of polysilicones, EPDM, polyurethanes, among a host of other materials known in this art to provide superior insulation quality. In terms of the sealant, any of the known sealants capable of chemically bonding with the polymeric material of the spacer 16 can be selected. Suitable sealants are well documented in the prior art and will be readily apparent to those skilled in the art.

In the event that sealants are chosen which require heat energy to induce fusion between adjacent sections of spacer 16 and sealant material 22, the assembly may be exposed to ultraviolet light, infrared heat or simply convective heat in order to induce the fusion between the sealant 22 and the adjacent sections of spacer 16.

Where the polymeric spacer material content and the sealant are not conducive to heat bonding with one another, additives may be included in the sealant to induce chemical fusion without the input of any extraneous energy.

Figure 3:
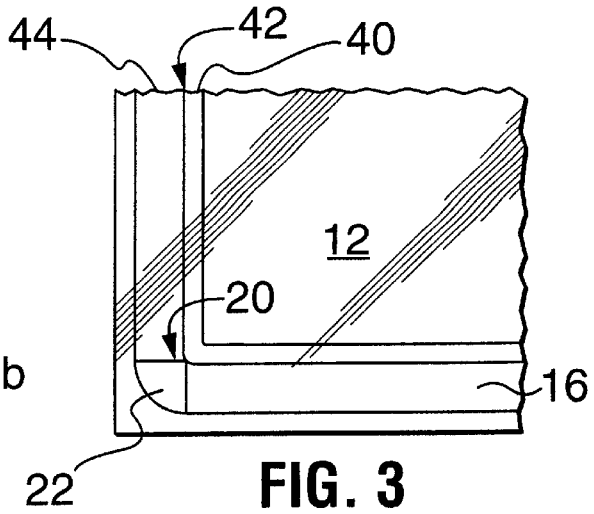
FIG. 3 is an enlarged view of two adjacent spacer sections at an incised corner.

FIG. 3 is an enlarged view showing the spacer material having been incised or slit at a corner portion to provide a generally triangular gap 20 where flexed. The angle formed by the sides of the gap approximately equals the corner angle of the assembly. Thus, in a conventional rectangular assembly, the angle approximates 90°. The spacer remains intact and in one piece towards the interior of the assembly, but is discontinuous at the exterior of the assembly as shown. Conveniently, the intact portion of spacer may include a gas-impermeable membrane, thus maintaining the seal integrity against gas leakage. In this manner, the spacer 16 remains at least partially integral towards the interior of the assembly, but is slit to accommodate flexing about the corner portions of the window assembly. It will be understood that the spacer 16 can be similarly slit in order to bend the spacer 16 about a remain corners of the assembly. In this arrangement, sealant material 22 is injected into the generally triangular gap 20 in order to fusibly connect the adjacent sections of spacer 16 thus restoring the thermal properties to substantially the same as a completely intact section of spacer. At the terminal corner (not shown) where the spacer starts and finishes, the joint between adjacent sections can be similar to that illustrated in FIG. 3.

In a further aspect of the invention, the spacer is positioned substantially adjacent to the perimeter of the glass panes, thus eliminating the step during assembly of backfilling about the entire spacer assembly. In this version, the spacer comprises a flexible polymeric compound structure, featuring a gas-impermeable membrane adjacent to a first of the assembly, which when the spacer is installed faces inwardly towards the interior of the window assembly. Triangular incisions within the spacer define sharp corners, with the incision leaving the membrane intact as described above. The combination of the impermeable membrane and the corners sealant material permits the fabrication of a window assembly that does not require backfilling about the entire periphery of the spacer to provide additional sealant or insulation.

Figure 4:
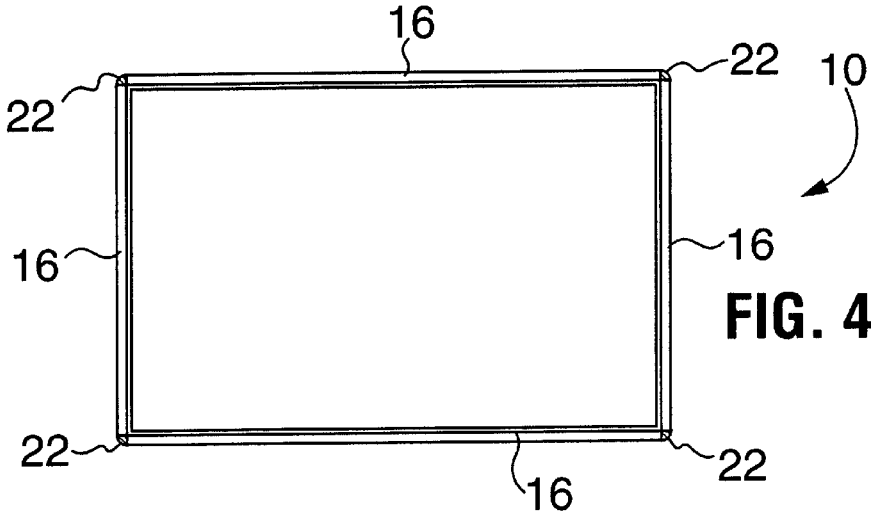
FIG. 4 is a plan view illustrating an assembly according to the present invention.

FIG. 4 illustrates an assembly wherein all four corners feature a peripheral slitting of the seal and corner sealant according to the present invention, with the spacer extending substantially to the edges of the assembly. As shown, the spacer is substantially free from contact with the sealant except at the corners, where the sealant material fills in the corner discontinuities within the spacer.

In order to apply the spacer and sealant material, any of the known automation systems or gunning arrangements can be employed.

By practising the present invention disclosed herein, significant results in terms of restoring the thermal conductivity of the corner portions or sections of abutting or adjacent spacer sections have been found to be restored to substantially the same conductivity of an uninterrupted length of sealant material.

This is in marked contrast to what the prior art has previously proposed where corner portions were simply taped or sealant material injected which did not facilitate bonding between the sections, but rather simply constituted filler material in order to remove the gap in the length of the spacer material around the periphery of the assembly.

As indicated above, suitable sealants and spacer material polymeric content will be readily apparent to those skilled in the art. This is equally true of the gunning or filling techniques and the means, where required, to induce fusion between adjacent sections of spacers 16. Typically, one of the more preferred systems is to provide a sealant material 22 having a melting point lower than that of the polymeric of which the spacer 16 is made such that there is no detrimental effect to the spacer 16 but rather only a melting or lowering of viscosity of the sealant material such that it is capable of fusible interaction with the spacer 16.

Although embodiments of the invention have been described above, it is not limited thereto and it will be apparent to those skilled in the art that numerous modifications form part of the present invention insofar as they do not depart from the spirit, nature land scope of the claimed and described invention.

I claim:

1. A composite insulated glass assembly having corners and corner angles and comprising:

a pair of glass substrates and spaced relation, each defined by corners and an outer edge at the perimeter thereof;

an insulating polymeric spacer body between and spacing the substrates, and positioned above the perimeter of said substrates substantially adjacent outer edges thereof, the spacer body featuring at least partial discontinuity therein, generally adjacent at least one of said corners said at least one partial discontinuity opening towards and communicating with the outside of said at least one corner; and sealant material within said discontinuity in contact with and bonded to the spacer body, wherein said spacer body is substantially free of contact with said sealant material except at said at least one corner.

2. An assembly as claimed in claim 1, said substrates having corners, said discontinuity featuring an angle of opening substantially equal to the corresponding corner angle.

3. An assembly as claimed in claim 2, said V-shaped opening extending part way through said spacer body.

4. An assembly as claimed in claim 1, wherein said spacer body is positioned about the perimeter of said substrates and substantially adjacent the outer edges thereof.

5. An assembly as claimed in claim 1, and said sealant material comprises a different material from the first material.

6. An assembly as claimed in claim 1, wherein said spacer body is formed from a first material comprising an insulating, resilient, flexible material and said sealant material is fusibly connected to said first material to form a one piece integral seal between the spaced substrates.

7. An assembly as claimed in claim 1, wherein said spacer body comprises a multicomponent structure featuring a first layer comprising a resilient insulating material and a second layer comprising a flexible substantially gas impervious layer, said first layer facing the perimeter of said assembly and said second layer facing the interior of said assembly, and wherein said discontinuity extends substantially through said first layer but not into said second layer.

8. A composite insulated glass assembly having corners and corner angles and comprising:

a pair of glass substrates in spaced relation, each defined by corners and an outer edge at the perimeter thereof;

an insulating resilient polymeric spacer body between and spacing the substrates, the spacer body featuring an at least partial discontinuity therein generally adjacent at least one of said corners; and sealant material within said discontinuity in contact with and bonded to the spacer body;

said at least partial discontinuity being generally V-shaped and opening towards and communicating with the outside of said at least one corner.

9. An assembly as claimed in claim 8, said substrates having corners, said discontinuity featuring an angle of opening substantially equal to the corresponding corner angle.

10. An assembly as claimed in claim 9, said V-shaped opening extending part way through said spacer body.

11. An assembly as claimed in claim 8, wherein said spacer body is positioned about the perimeter of said substrates and substantially adjacent the outer edges thereof.

12. An assembly as claimed in claim 8, and said sealant material comprises a different material from the first material.

13. An assembly as claimed in claim 8, wherein said spacer body is formed from a first material comprising an insulating, resilient, flexible material and said sealant material is fusibly connected to said first material to form a one piece integral seal between the spaced substrates.

14. An assembly as claimed in claim 8, wherein said spacer body comprises a multicomponent structure featuring a first layer comprising a resilient insulating material and a second layer comprising a flexible substantially gas impervious layer, said first layer facing the perimeter of said assembly and said second layer facing the interior of said assembly, and wherein said discontinuity extends substantially through said first layer but not into said second layer.

15. An assembly as claimed in claim 11, wherein said spacer body is substantially free of contact with said sealant material except at said at least one corner.

16. A method of forming an insulated glass assembly, comprising the steps of:

providing a pair of glass substrates having corners;

positioning a continuous length of resilient polymeric insulating spacer between the substrates about the periphery of said substrates, at said spacer defined by an exterior face and an interior face;

wherein said spacer is characterized by at least one at least partial discontinuity adjacent at least one of said corners, said at least partial discontinuity opening towards and communicating with the outside of said at least one corner;

providing a sealant material having a melting point lower than a melting point of the spacer, the sealant comprising a material chemically compatible with the spacer and capable of fusing therewith; and introducing melted sealant material into contact with the spacer at said at least one corner substantially filling said at least one discontinuity to form a generally integral one piece fused gas impervious junction between the spacer and the sealant material to restore the coefficient of thermal conductivity of the corner portions to substantially equal or exceed the coefficient of thermal conductivity of the continuous length of the spacer material.

17. A method as claim in claim 16, wherein said spacer is incised to create said discontinuity.

18. A method as claimed in claim 17, wherein said incision comprises a slit extending from the exterior face towards said interior face, which when extended around said corner opens into a generally V-shaped opening the angle of which approximates the corner angle.

19. A method as in claim 17, further comprising the step of creating said incision partly transecting the spacer at a point where said spacer is adjacent to at least one corner portion of the substrate to form a flex point about which the spacer may be flexed about said at least one corner.

20. A method as in claim 16, comprising the further steps of:

exposing the assembly to a source of energy sufficient to at least partially melt the sealant material; and fusing the spacer with the sealant to form a one piece integral seal between the substrates.

21. A method as claimed in claim 16, wherein said spacer comprises a multicomponent structure featuring a first layer comprising a resilient insulating material and a second layer comprising a flexible substantially gas impervious layer, said spacer being positioned on said substrates such that said first layer faces the perimeter of said assembly and said second layer faces the interior of said assembly, and wherein said discontinuity extends substantially through said first layer but not into said second layer.

22. A method as claimed in claim 21, wherein said spacer is incised at said corner to create said partial discontinuity.

23. A method as claimed in claim 21, wherein said spacer is substantially free of contact with said sealant material except at said at least one corner.

* * * * *